US005413495A

United States Patent [19]

Takeuchi et al.

[11] Patent Number: 5,413,495

[45] Date of Patent: May 9, 1995

[54] FEMALE TERMINAL

[75] Inventors: Kunihiko Takeuchi; Akihiko Chiriku; Satsuki Kanezashi; Hiroto Tanishita, all of Shizuoka, Japan

[73] Assignee: Yazaki Corporation, Japan

[21] Appl. No.: 155,779

[22] Filed: Nov. 23, 1993

[30] Foreign Application Priority Data

Nov. 24, 1992 [JP] Japan ..... 4-313734

[51] Int. Cl.[6] ..... H01R 27/00

[52] U.S. Cl. ..... 439/223; 439/852

[58] Field of Search ..... 439/218, 222, 223, 59, 439/852

[56] References Cited

U.S. PATENT DOCUMENTS 3,842,391 10/1974 Dechelette ..... 439/223

4,033,658 7/1977 Asick ..... 439/218

FOREIGN PATENT DOCUMENTS 2-076480 6/1990 Japan .

783620 9/1957 United Kingdom ..... 439/223

*Primary Examiner*—Kenneth J. Ramsey

*Attorney, Agent, or Firm*—Wigman, Cohen, Leitner & Myers

[57] ABSTRACT

The female terminal (10) of the present invention is electrically connectable with both first and second male terminals 1*a*, 3*a* having different thickness. This female terminal has a tubular portion (11) in which either one of the first and second male terminals is inserted. In the tubular portion a common contact portion (13) for contacting in common with the first or second male terminal, and first and second individual contact portions (15, 16) are provided. The first individual contact portion (15) contacts with the first male terminal (3*a*), while the second individual contact portion (16) contacts with the second male terminal (1*a*). Either one of the common contact portion and the first and second individual contact portions is formed with a spring plate (12).

4 Claims, 9 Drawing Sheets

FEMALE TERMINAL

BACKGROUND OF THE INVENTION

The present invention relates to a female terminal for connection to corresponding fuses, male terminals of bus bar or male terminals connected to wire harness.

Recently, as fuses for use in vehicles, so-called mini-fuses have been used In place of auto-fuses which are generally larger in size than such mini-fuses.

Because the auto-fuse is different from the mini-fuse in thickness as well as in pitch and width of the male terminal portion, the female terminals for both fuses must have been prepared individually.

FIG.1 shows a pair of conventional auto-fuse 1 and female terminal 2, and FIG. 2 shows a pair of conventional mini-fuse 3 and female terminal 4. A typical example of such a conventional female terminal is disclosed in Japanese Utility Model Laid Open (Kokai) No. (HEI)2-76480.

Accordingly, when vehicles employ such conventional auto-fuses and mini-fuses together, the types of these terminals must be increased so that the maintenance and preparation of such various parts be very troublesome.

Additionally, in the electric connection box provided in the engine room or the like place of vehicles, junction terminals (which are so-called female-female type terminals and will be called herein as "female junction terminals") are used for connection of each male terminal of wire harness derived from each electric part to each male terminal of bus bar or for connection of male terminals between wire harness terminal portions.

FIG.3 shows a pair of female junction terminals 5*a*, 5*b* used in an electric connection box 9, bus bar 6 and male terminal 8 connected to one end of electric wire, the latter two of which are to be inserted respectively in the former, i.e., the corresponding Junction terminals 5*a*, 5*b* . In such a case, since the male terminal portion 6*a* of bus bar 6 is different in thickness and width from the male terminal portion 8*a* of metal terminal 8, the female junction terminal 5*a* corresponding to the male terminal portion 6*a* of bus bar 6 and the other female Junction terminal 5*b* for the male terminal portion 8*a* of terminal 8 of the prior art must be constructed as parts of different types.

However, different construction in these female junction terminals for the male terminal of bus bar and for the male terminal does not only increase the types of such junction terminals 5*a*, 5*b*, but also require much trouble in maintenance and preparation of such parts.

SUMMARY OF THE INVENTION

Therefore, it is an object of the present invention to provide a female terminal which can connect with two types of male terminals having different thickness without causing any problems as described above.

To achieve the above object, the present invention provides a female terminal electrically connectable with both first and second male terminals having different thickness, comprising:

an insertion portion in which either one of the first and second male terminals is inserted;

a common contact portion provided in the insertion portion to contact commonly with the first or second male terminal; and first and second individual contact portions provided in the insertion portion, the first individual contact portion contacting with the first male terminal, and the second individual contact portion contacting with the second male terminal;

wherein either one of the common contact portion and the first and second Individual contact portions is formed with spring materials.

According to the female terminal of the above construction, when the first male terminal is inserted in the insertion portion, the first male terminal is held between the common contact portion and the individual contact portion corresponding to the first male terminal. On the other hand, when the second male terminal is inserted in the insertion portion, the second male terminal is held between the common contact portion and the individual contact portion corresponding to the second male terminal. Therefore, by adjusting the gap and spring force between each individual contact portion and the common contact portion according to each thickness of the first and second male terminals, both the first and second male terminals can be held stably by a suitably balanced force.

These and other objects, features and advantages of the present invention will be more apparent from the following description of the several disclosed embodiments, taken in conjunction with the accompanying drawings.

BRIEF DESCRIPTION OF THE DRAWING

FIGS. 11A, 11B show a female terminal as third embodiment of the present invention, in which FIG. 11A shows its perspective view, and FIG. 11B shows its bottom view.

FIG. 12A, 12B show a female connector for common use in both auto-fuses and mini-fuses produced by symmetrically arranging a pair of female terminals as third embodiment of the present Invention, in which FIG. 12A shows its cross-sectional side view, and FIG. 12B shows its plan view.

FIGS. 16A, 16B show the female Junction terminal as fourth embodiment, in which FIG. 16A is a cross section showing a state before the male terminal portion of the male terminal is inserted in the Insertion portion of the female junction terminal, and FIG. 16B is a cross section showing a state after that insertion.

FIG. 18A, 18B show the female junction terminal as fourth embodiment, In which FIG. 18A is a cross section showing a state before the male terminal portion of bus bar is inserted in the insertion portion of the female junction terminal, and FIG. 18B is a cross section showlng a state after that insertion.

DETAILED DESCRIPTION OF THE EMBODIMENT

Hereinafter, several embodiments of the present invention will be described with reference to the accompanying drawings.

First Embodiment

Figure 4:
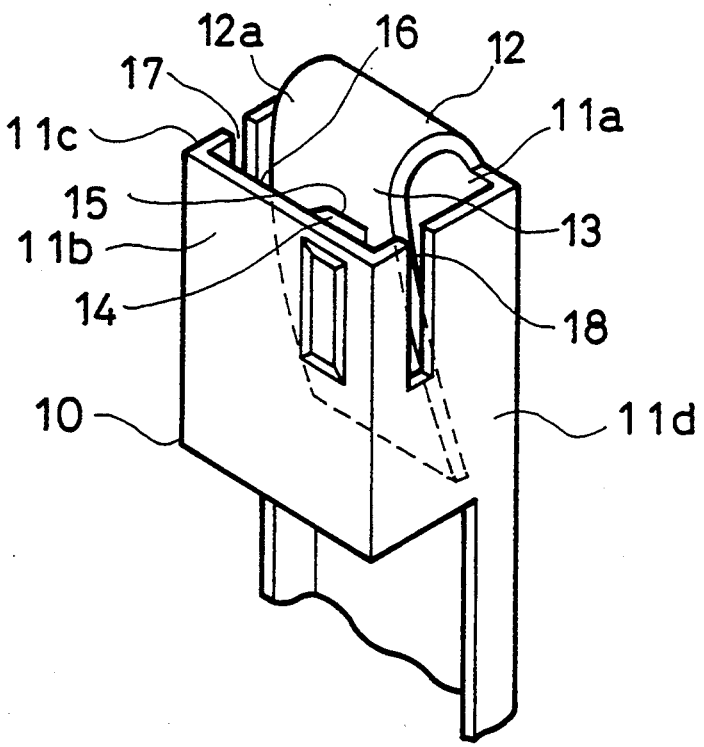
FIG. 4 is a perspective view of a female terminal as the first embodiment of the present invention.
Figure 5:
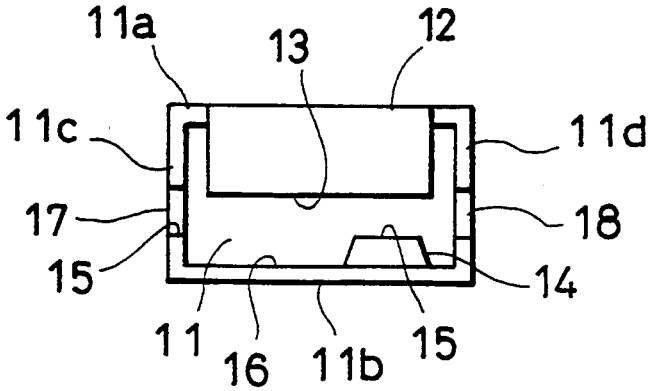
FIG. 5 is a plan view of the female terminal as the first embodiment of the present invention.

FIGS. 4 and 5 show the construction of female terminal 10 of the first embodiment, respectively. The female terminal 10 is formed In a tubular shape having a rectangular cross section. The female terminal 10 has an insertion portion 11 inside so as to receive the male terminal portion of a mating fuse from an opening at its one end (the top end shown in FIG. 4).

The insertion portion 11 is constructed with a pair of wider side walls 11*a*, 11*b* and a pair of narrower side walls 11*c*, 11*d*, the wider side walls facing and being connected to each other through both the narrower side walls. A spring plate 12 extends Integrally from the side wall 11*a*, and a movable portion 12*a* is formed by bending that spring plate in a U-shape inside the insertion portion. The outer face of movable portion 12*a* faces the inner face of the other wider side wall 11*b* to define a common contact face (common contact portion) 13 to be commonly in contact with the first and second male terminal portions of auto-fuse and mini-fuse.

In the inner wall of side wall 11*b* a projection 14 is formed near its one edge in the direction of width. The projection 14 is formed by pressing from the exterior of side wall 11*b*.

The face of projection 14 opposite to common contact face 13 is defined as first individual contact face 15 (first individual contact portion) for contacting with the other side face of first male terminal portion of the auto-fuse. Moreover, the inner face of side wall 11*b* other than the projection 14 is defined as second individual contact face 16 (second individual contact portion) for contacting the other side face of the mini-fuse. That is, the projection 14 is so located as to make a space in the front of second individual contact face 16 for receiving the second male terminal portion of the mini-fuse therein.

Figure 1:
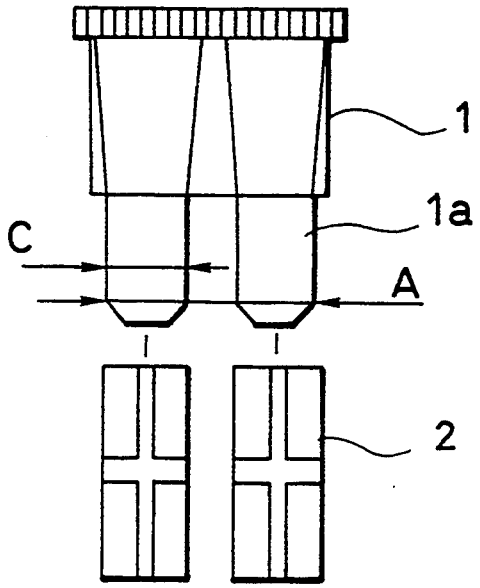
FIG. 1 PRIOR ART
FIG. 1 is a side view of an auto-fuse and its female terminal.

In this embodiment, the distance between narrower side walls 11*c* and 11*d* is shorter than the width of first male terminal portion la of auto-fuse 1 in FIG. 1. Thus, slits 17, 18 are formed respectively in the side walls 11*c* 11*d* to insert the male terminal portion la of auto-fuse 1 therein.

In this case, the inner side face of slit 17, i.e., the farther slit to the projection 14, nearer to the side wall 11*b* defines the same face as first Individual contact face 15 of projection 14 and acts as part of that contact face 15.

On the other hand, the inner side face of slit 18 nearer to the side wall 11*b* is located nearer to the wall 11*b* than the first individual contact face 15 of projection 14. Therefore, that inner side face does not contact with the male terminal portion 1*a* of auto-fuse 1. Accordingly, the male terminal portion 1*a* of auto-fuse 1 contacts with the female terminal 10 at two points, i.e., the first individual contact face 15 of projection 14 and the inner side face (as part of the first individual contact face 15) of slit 17. Thus, that two-point contact system can provide more stable contact relation between these two parts as compared with the case of three-point contact system including the contact by the inner side face of slit 18. However, it is also possible to adopt that three-point contact system in this embodiment.

The distance between first individual contact face 15 and common contact face 13 and that between second individual contact face 16 and common contact face 13 are determined corresponding to the thickness of first male terminal portion 1*a* of auto-fuse 1 and that of male terminal portion 3*a* of mini-fuse 3, respectively. In this case, it should be noted that the contact pressure of each fuse to the first or second male-terminal portion 1*a*, 1*b* is adjusted to be constant.

Figure 2:
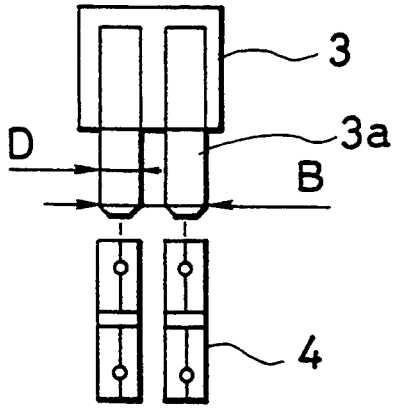
FIG. 2 PRIOR ART
FIG. 2 is a side view of a mini-fuse and its female terminal.
Figure 3:
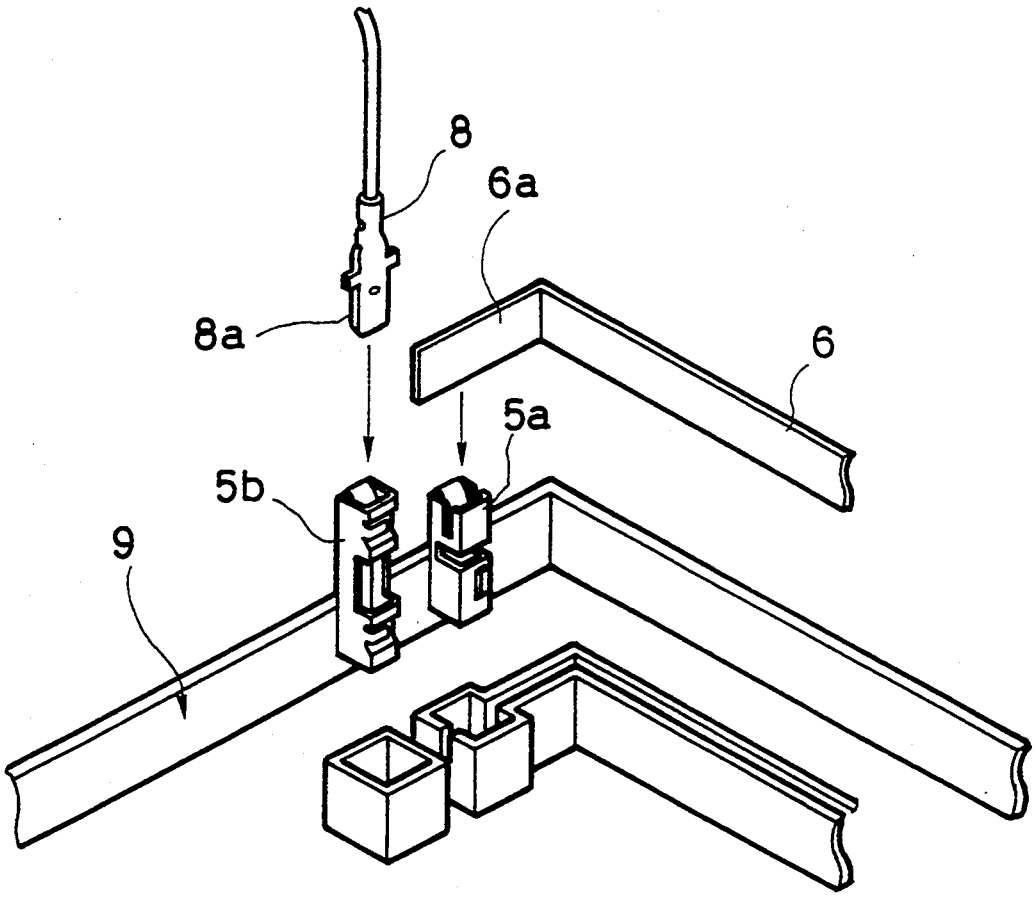
FIG. 3 PRIOR ART
FIG. 3 is a perspective view showing a male terminal of bus bar, a male terminal at one end of electric wire and female junction terminals disposed in an electric connection box.
Figure 6:
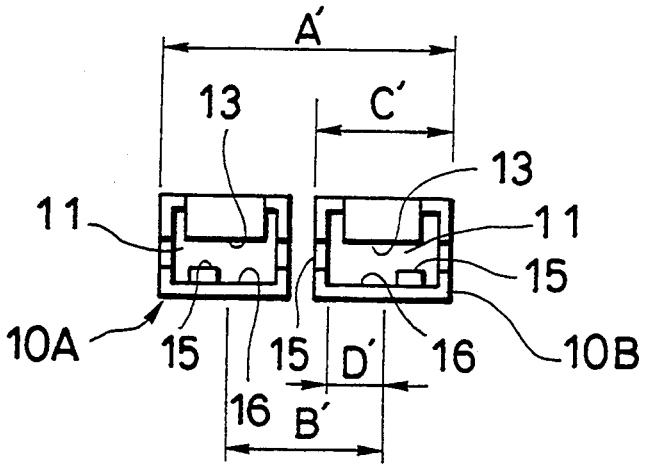
FIG. 6 is a plan view of a female connector for common use in both auto-fuses and mini-fuses produced by symmetrically arranging a pair of female terminals as first embodiment of the present invention.

A female connector applicable to common use in both auto-fuses and mini-fuses can be constructed by symmetrically arranging a pair of such female terminals 10 (10A, 10B) as shown in FIG. 6. In this case, each dimension of A, B, C, D shown in FIGS. 1 and 2 correspond to each dimension of A′, B′, C′, D′ in FIG. 6 in accordance with each pitch of first and second male terminal portions 1*a*, 3*a* of auto-fuse 1 and mini-fuse 3.

Figure 7:
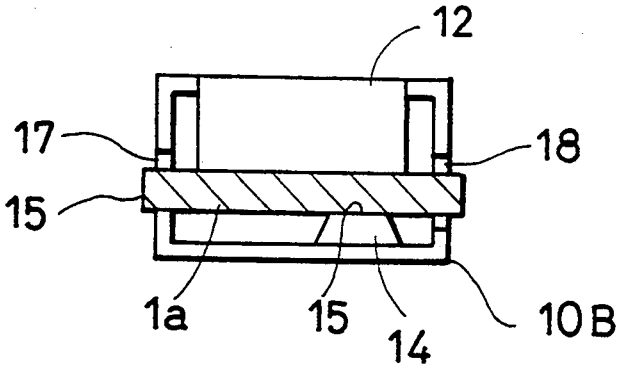
FIG. 7 is a plan view showing a state in which the male terminal portion of an auto-fuse is inserted in the female terminal as first embodiment of the present invention.

On the insertion of auto-fuse to the female connector constructed by such arrangement of female terminals 10A, 10B, as shown in FIG. 7, the first male terminal portion 1*a* of auto-fuse 1 is inserted in the insertion portion 11 of female terminal 10B. In that case, both ends of first male terminal portion 1*a* are inserted in slits 17, 18, respectively. Thus, the first male terminal portion is held between the first individual contact faces 15 of projection 14 and of slit 17 and the common contact face 13 provided on spring plate 12.

Figure 8:
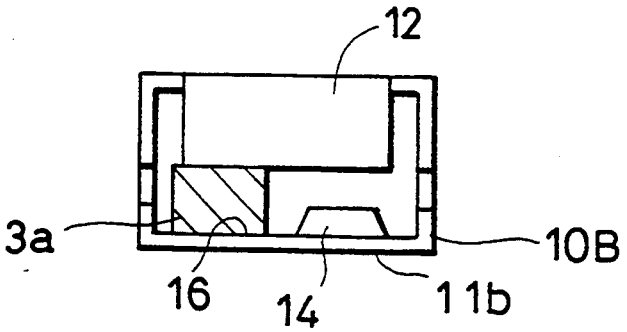
FIG. 8 is a plan view showing a state in which the male terminal portion of a mini-fuse is inserted in the female terminal as first embodiment of the present invention.

On the insertion of mini-fuse to the same female connector, as shown in FIG. 8, the second male terminal portion 3*a* of mini-fuse 3 is inserted in the insertion portion 11 of female terminal 10B, and is thus held between the second individual contact face 16 in the inner face of side wall 11*b* and the common contact face 13 on the spring plate 12.

In this case, since the location of each individual contact face 15, 16 to the common contact face 13 is determined corresponding to each thickness of the first and second male terminal portions 1*a*, 3*a* of auto-fuse 1 and mini-fuse 3, in either case, both the first and second male terminal portions can be held under the same contact pressure by the same deflection adjustment of spring plate 12.

Second Embodiment

Figure 9:
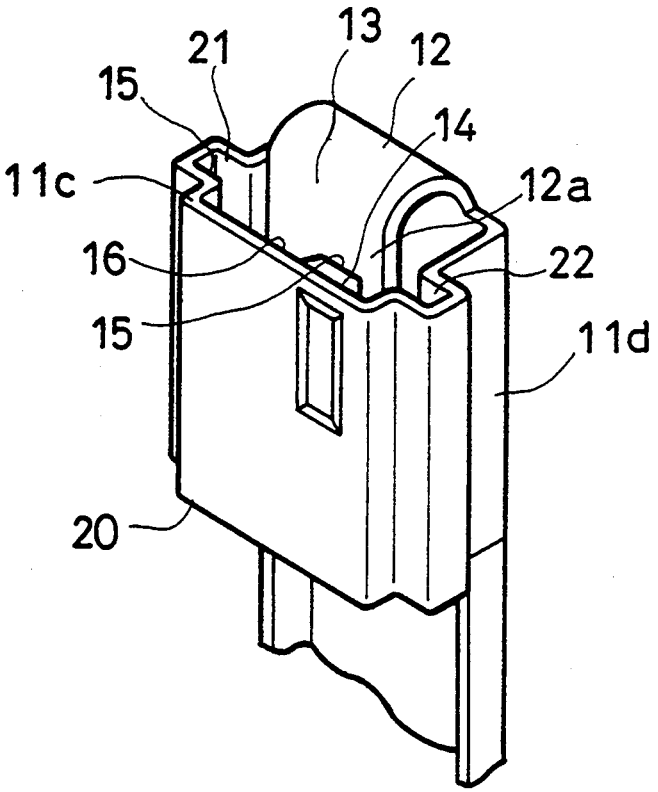
FIG. 9 is a perspective view of a female terminal as second embodiment of the present Invention.
Figure 10:
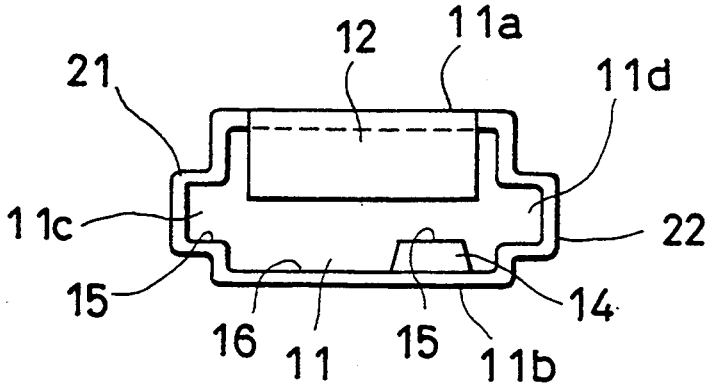
FIG. 10 is a plan view of the female terminal as second embodiment of the present invention.

Next, the second embodiment of the present invention will be described with reference to FIGS. 9 and 10.

In the above construction of female terminal 10 as first embodiment, slits 17, 18 for receiving the first male terminal portion of auto-fuse are provided in the respective narrower side walls 11*c* 11*d* constructing the insertion portion 11 as shown in FIG. 4. However, in the female terminal 20 as the second embodiment, insertion grooves 21, 22 are provided by bending each of the side walls 11*c* 11*d* in place of these slits.

In this case, the inner side face of insertion groove 21, the farther one to the projection 14, acts as part of the first individual contact face 15 to be in contact with the other side face of first male terminal portion of auto-fuse.

Because the other construction of this embodiment except the above difference is the same as the first embodiment, each like element is designated by each like reference numeral, and the description to such an element is omitted.

Third Embodiment

Figure 11A:
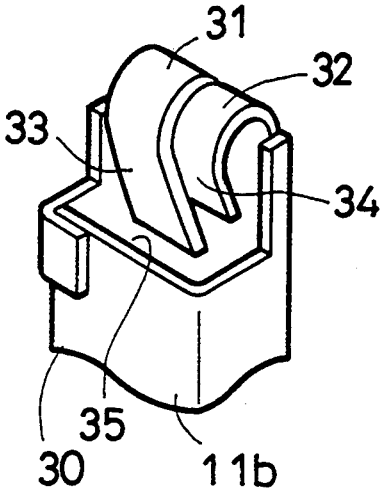
Figure 11B:
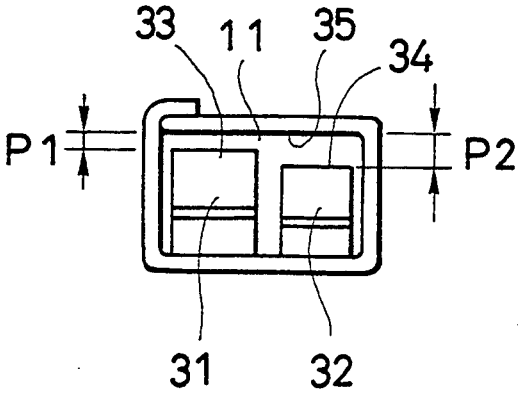

Next, the third embodiment of the present invention will be described with reference to FIGS. 11 and 12.

In the above first and second embodiments, the common contact face 13 is provided in the movable portion of spring plate 12, and the individual contact faces 15, 16 are provided in the inner face of side wall or end face of projection. However, in the female terminal 30 as the third embodiment, two spring plates 31, 32 are so arranged in parallel that the outer face of movable portion in each spring plate 31, 32 defines an individual contact face 33 to be in contact with one side face of the first male terminal portion of auto-fuse and another individual contact face 34 to be in contact with one side face of the second male terminal portion of mini-fuse. On the other hand, the inner face of side wall 11*b* constructing the insertion portion 11 acts as the common contact face 35.

The distance P1, P2 between each individual contact face 33, 34 and the common contact face 35 is determined corresponding to each thickness of the first and second male terminal portions of auto-fuse and mini-fuse. Since the other construction of this embodiment except the above difference is the same as the first embodiment, each like element is shown by each like reference numeral, and the description to such an element is omitted.

Figure 12A:
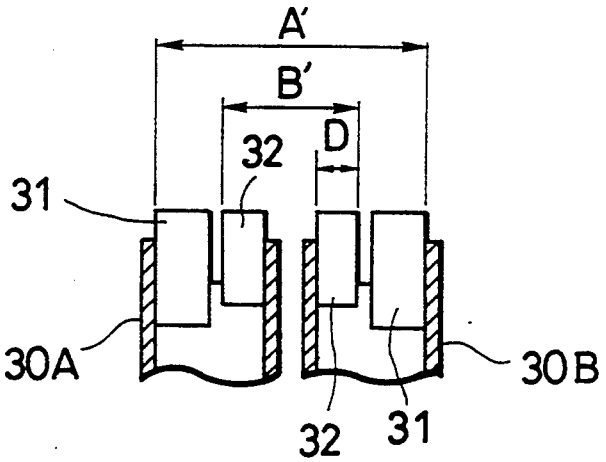
Figure 12B:
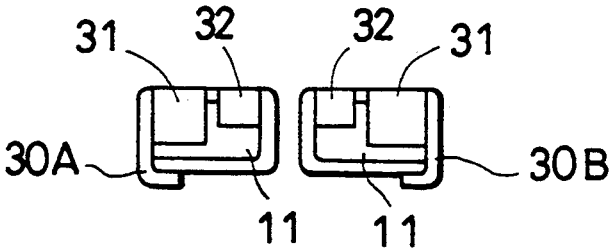

Also in this case, a female connector applicable to common use in both auto-fuses and mini-fuses can be constructed by symmetrically arranging a pair of such female terminals 30 (30A, 30B) as shown in FIG. 12. The positional relation between the pair of female terminals 30A and 30B is so determined as to set the distance between both their spring plates 31 larger than that between their spring plates 32. In addition, each dimension of A, B, D shown in FIGS. 1 and 2 corresponds to each dimension of A′, B′, D′ in FIG. 12 in accordance with each pitch of first and second male terminal portions of the auto-fuse and mini-fuse.

In this embodiment the spring plates 31,32 are formed integrally with the side wall 11*a*. However, it is also possible to produce only the parts of such spring plates separately and then attach them to the side wall.

Fourth Embodiment

Next, the fourth embodiment of the present invention will be described with reference to FIGS. 13 to 18.

In the above first, second and third embodiments, several types of female terminals for electrical connection to the male terminal portion of fuse were described. This embodiment, however, the present invention is applied to the female junction terminal 40 to which the male terminal portion (first male terminal) 8*a* of male terminal 8 in connection with one end of electric wire and the male terminal portion (second male terminal) 6*a* of bus bar 6 are electrically connected.

Figure 13:
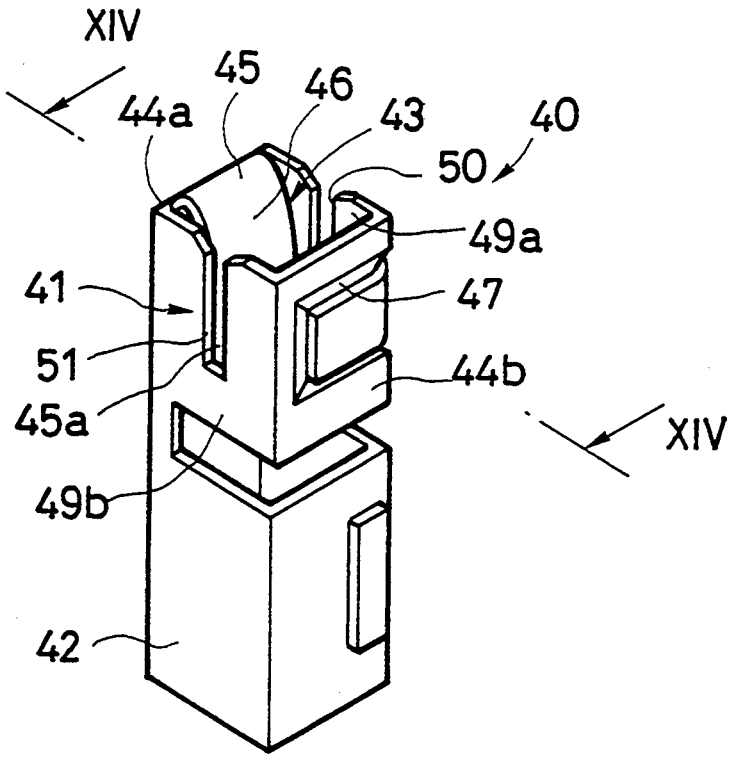
FIG. 13 is a perspective view of a female Junction terminal as fourth embodiment of the present invention.
Figure 14:
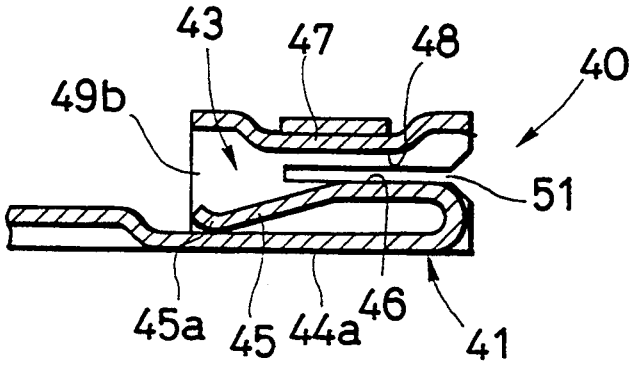
FIG. 14 is a sectional view taken along XIV—XIV in FIG. 13, showing the female Junction terminal as fourth embodiment of the present invention.

As shown in FIGS. 13 and 14, the female junction terminal 40 is formed in a tubular shape with a rectangular cross section. At both upper and lower ends of the terminal 40 female terminal portions 41 and 42 are provided respectively. The interior of female terminal portion 41 is constructed as insertion portion 43 to both the male terminal portion 6*a* of bus bar 6 and the male terminal portion 8*a* of male terminal 8. The other female terminal portion 42 acts as terminal portion to be in contact with a metal terminal at one end of electric-wire derived from an electric part or the like member (not shown). In this embodiment, the present invention applied to the female terminal portion 41.

In the side wall 44*a*, one of side walls 44*a*, 44*b* constructing the insertion portion 43, spring plate 45 having movable portion 45*a* is formed by bending in a U-shape gone end portion of side wall 44*a* extending from the top end. The outer face of movable portion 45*a* faces the side wall 44*b* and defines the common contact face 46 to be in contact in common with the male terminal portion 6*a* of bus bar 6 and one side face of male terminal 8.

On the other hand, projection 47 is formed in the inner face of side wall 44*b*. The projection 47 is formed by pressing from the outside of side wall 44*b*. The end face of projection 47 is defined as first individual contact face 48 to be in contact with the other face of terminal portion 8*a* of male terminal 8.

In addition, slits 50, 51 are formed in the other side walls 49*a*, 49*b* respectively adjacent to the side walls 44*a* , 44*b*. In these slits 50, 51 the male terminal portion 6*a* of bus bar 6 is Inserted. Each inner wall of slits 50, 51 facing the common contact face 46 is defined as second individual contact face 52 to be in contact with the other side face of male terminal portion 6*a* of bus bar 6.

Figure 15:
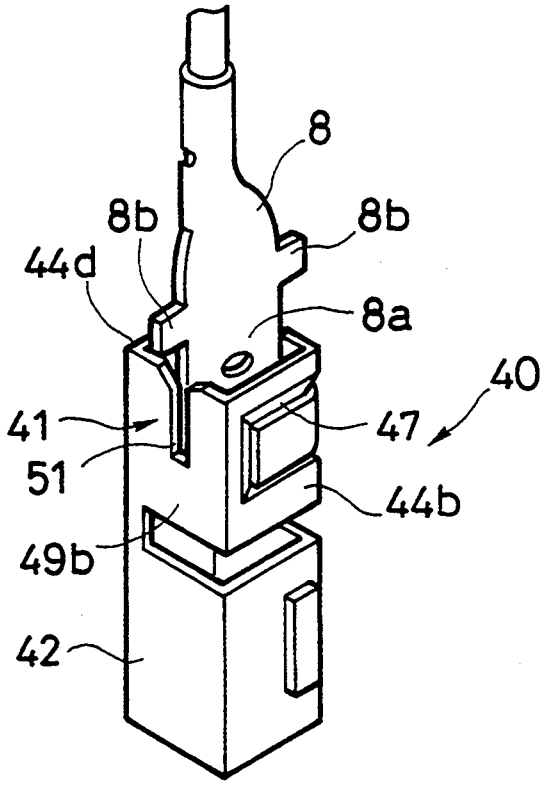
FIG. 15 is a perspective view showing a state in which a male terminal disposed at one end of electric wire is inserted in the female Junction terminal as fourth embodiment.
Figure 16A:
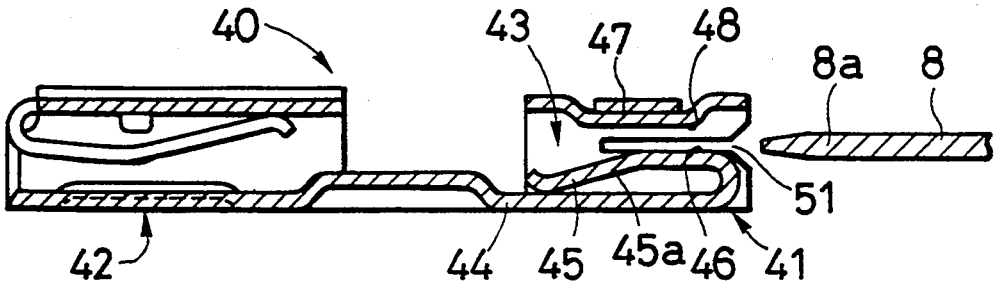
Figure 16B:
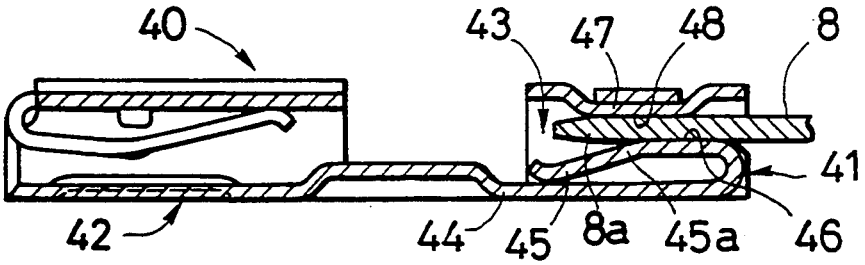

On the insertion of male terminal portion 8*a* of male terminal 8 in such a female junction terminal 40, as shown in FIGS. 15 to 16B, the male terminal portion 8*a* of male terminal 8 is inserted in the insertion portion 43 of that female junction terminal. In this case, the male terminal 8 contacts with the common contact face 46 of spring plate 45 at its one face and with the first individual contact face 48 of projection 47 at the other face, and is thus held between these contact faces 46, 48.

Figure 17:
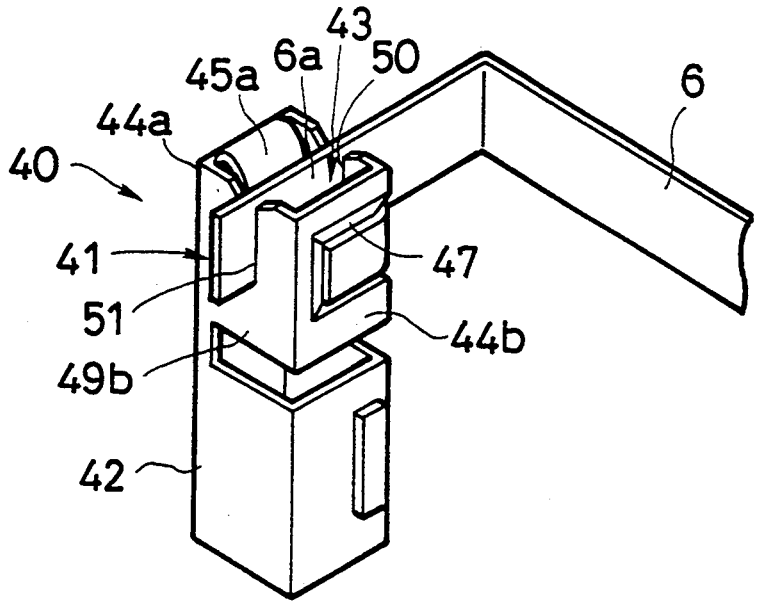
FIG. 17 is a perspective view showing a state in which the male terminal portion of bus bar is inserted in the female Junction terminal as fourth embodiment.
Figure 18A:
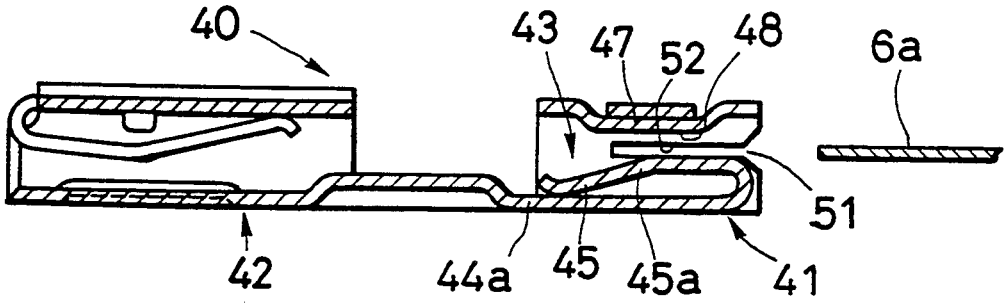
Figure 18B:
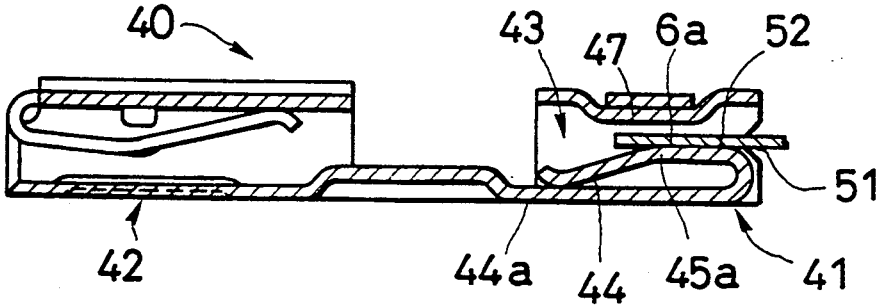

On the insertion of male terminal portion 6*a* of bus bar 6 is inserted in the female junction terminal 40, as shown in FIGS. 17 to 18B, the terminal portion 6*a* is inserted In the insertion portion 43. In this case, the male terminal portion 6*a* contacts with the common contact face 46 of spring plate 45 at its one face and with the second individual contact face 52 of slits 50, 51 at the other face, and is thus held by these contact faces 46, 52.

In this case, projections 8*b*, 8*b* are provided on both sides of male terminal 8 to restrict the insertion amount of male terminal portion 8*a* into the insertion portion 43 by contacting with the distal end face of female junction terminal 40.

As stated above, according to the present invention, it becomes possible to electrically connect in common the first and second male terminals having different thickness. Moreover, since the inventive female terminal can stably hold either of the first and second male terminals having different thickness, the standardization of this part becomes possible.

Various modifications will become possible for those skilled in the art with receiving the teachings of the present disclosure without departing from the scope thereof.

What is claimed is:

1. A female terminal electrically connectable with both first and second male terminals having different thickness, comprising:

an insertion portion constructed with a tubular member in which either one of the first and second male terminals is inserted, the tubular member having first and second side walls facing each other and third and fourth side walls connecting these first and second side walls, the third and fourth side walls respectively having slits for receiving the second male terminal therein;

a common contact portion formed with a spring plate extending integrally with the first side wall of the insertion portion to contact commonly with the first or second male terminal;

a first individual contact portion provided in the second side wall to contact with the first male terminal; and a second individual contact portion constructed with a projection formed In the second side wall and an inner wall of the slit formed in the third side wall so as to contact with the second male terminal.

2. A female terminal electrically connectable with both first and second male terminals having different thickness, comprising:

an insertion portion constructed with a tubular member in which either one of the first and second male terminals is inserted, the tubular member having first and second side walls facing each other and third and fourth side walls connecting these first and second side walls, the third and fourth side walls respectively having recesses for receiving the second male terminal therein;

a common contact portion formed with a spring plate extending integrally with the first side wall of the insertion portion to contact commonly with the first or second male terminal;

a first individual contact portion provided in the second side wall to contact with the first male terminal; and a second individual contact portion constructed with a projection formed in the second side wall and an inner wall of the recess formed in the third side wall so as to contact with the second male terminal.

3. A female terminal electrically connectable with both first and second male terminals having different thickness, comprising:

an insertion portion constructed with a tubular member in which either one of the first and second male terminals is inserted, the tubular member having first and second side walls facing each other and third and fourth side walls connecting these first and second side walls, the third and fourth side walls respectively having slits for receiving the second male terminal therein;

a common contact portion formed with a spring plate extending integrally with the first side wall of the insertion portion to contact commonly with the first or second male terminal;

a first individual contact portion provided in the second side wall to contact with the first male terminal; and a second individual contact portion constructed with inner walls of both third and fourth side walls so as to contact with the second male terminal.

4. A female terminal electrically connectable with both first and second male terminals having different thicknesses, comprising:

an insertion portion constructed with a tubular member in which either one of the first and second male terminals is inserted, the tubular member having first and second side walls facing each other;

a common contact portion provided in the first side wall;

a first individual contact portion constructed with a first spring plate extending integrally with the second side wall, the first spring plate being spaced from the first side wall at a first predetermined gap to contact with the first male terminal; and a second individual contact portion constructed with a second spring plate extending integrally with the second side wall adjacent the first spring plate, the second spring plate being spaced from the first side wall at a second predetermined gap narrower than the first predetermined gap to contact with the second male terminal.

* * * * *